United States Patent [19]

Williamson et al.

[11] Patent Number: 5,064,135

[45] Date of Patent: Nov. 12, 1991

[54] BEAM COLLAR

[75] Inventors: Norman R. Williamson; John L. Elliott, both of Spartanburg, S.C.

[73] Assignee: Milliken Research Corporation, Spartanburg, S.C.

[21] Appl. No.: 606,299

[22] Filed: Oct. 31, 1990

[51] Int. Cl.[5] ..... B65H 75/18; B65H 75/24

[52] U.S. Cl. ..... 242/118.4; 242/118.5

[58] Field of Search ..... 242/118.5, 118.6, 118.4, 242/118.41, 117

[56] References Cited

U.S. PATENT DOCUMENTS

| | | | |
|---|---|---|---|
| 325,236 | 9/1885 | Burlingame | 242/118.5 |
| 368,122 | 8/1887 | Wyman | 242/118.5 |
| 776,082 | 11/1904 | O'Reilly | 242/118.5 |
| 1,433,402 | 10/1922 | Mossberg | 242/118.5 |
| 1,508,477 | 9/1924 | Schmidt | 242/118.5 |
| 2,027,749 | 1/1936 | Mossberg et al. . | |
| 2,144,989 | 1/1939 | Mossberg . | |
| 2,188,086 | 1/1940 | Mossberg . | |
| 2,578,018 | 12/1951 | Rovas . | |
| 2,658,699 | 11/1953 | Rovas . | |
| 4,937,926 | 7/1990 | Lee et al. | 28/191 |

FOREIGN PATENT DOCUMENTS

| | | | |
|---|---|---|---|
| 514917 | 11/1952 | Belgium | 242/118.5 |
| 387563 | 5/1965 | Switzerland | 242/118.5 |
| 27361 | 9/1907 | United Kingdom | 242/118.5 |
| 8794 | of 1909 | United Kingdom | 242/118.5 |

*Primary Examiner*—Stanley N. Gilreath

*Attorney, Agent, or Firm*—Kevin M. Kercher; H. William Petry

[57] ABSTRACT

A collar for partitioning a beam which includes a first c-shaped member and a second c-shaped member operatively attached to said first c-shaped member to form a first ring, and a third c-shaped member and a fourth c-shaped member operatively attached to said third c-shaped member to form a second ring, with said first ring and said second ring operatively attached to each other.

28 Claims, 3 Drawing Sheets

BEAM COLLAR

BACKGROUND OF THE INVENTION

This invention relates to an apparatus for dividing a beam into segments to facilitate optimization of yarn utilization.

There are a number of collars that can be attached to a cylindrical beam. Some of them require the collar to be slidably mounted over one of the ends of the beam such as U.S. Pat. No. 2,027,749, U.S. Pat. No. 2,144,989, U.S. Pat. No. 4,937,926 and U.S. Pat. No. 2,188,086. This can prove to be a burdensome and time consuming operation. Other collars such as U.S. Pat. No. 2,578,018 and U.S. Pat. No. 2,658,699 allow for a major portion of the collar to be removed leaving only a small circular thimble portion. However, this thimble portion must also be slidably mounted over one end of the beam.

The present invention solves the above problems and others in a manner not disclosed in the known prior art.

SUMMARY OF THE INVENTION

A collar for partitioning a beam that includes a first c-shaped member and a second c-shaped member operatively attached to said first c-shaped member to form a first ring, and a third c-shaped member and a fourth c-shaped member operatively attached to said third c-shaped member to form a second ring, with said first ring and said second ring operatively attached to each other.

It is an advantage of this invention to be able to divide a beam into sections thereby accomplishing optimal warping.

It is another advantage of this invention that the collar does not have to be slidably attached over one of the ends of a beam.

Yet another advantage of this invention is that the collar can be attached to a yarn beam without damaging the beam in any way.

Still another advantage of this invention is that the collar can be readily attached and removed from a beam with a minimum of labor or expense.

Another advantage of this invention is that the warping cycle time is optimized for short sets.

Yet another advantage of this invention is that pattern warping is facilitated.

Another advantage of this invention is that the collar is removedly attached so that a beam does not have to be dedicated or permanently altered.

These and other advantages will be in part obvious and in part pointed out below.

BRIEF DESCRIPTION OF THE DRAWINGS

The above as well as other objects of the invention will become more apparent from the following detailed description of the preferred embodiments of the invention, which when taken together with the accompanying drawings, in which.

Corresponding reference characters indicate corresponding parts throughout the several views of the drawings.

DETAILED DESCRIPTION OF THE PREFERRED EMBODIMENT

Figure 1:
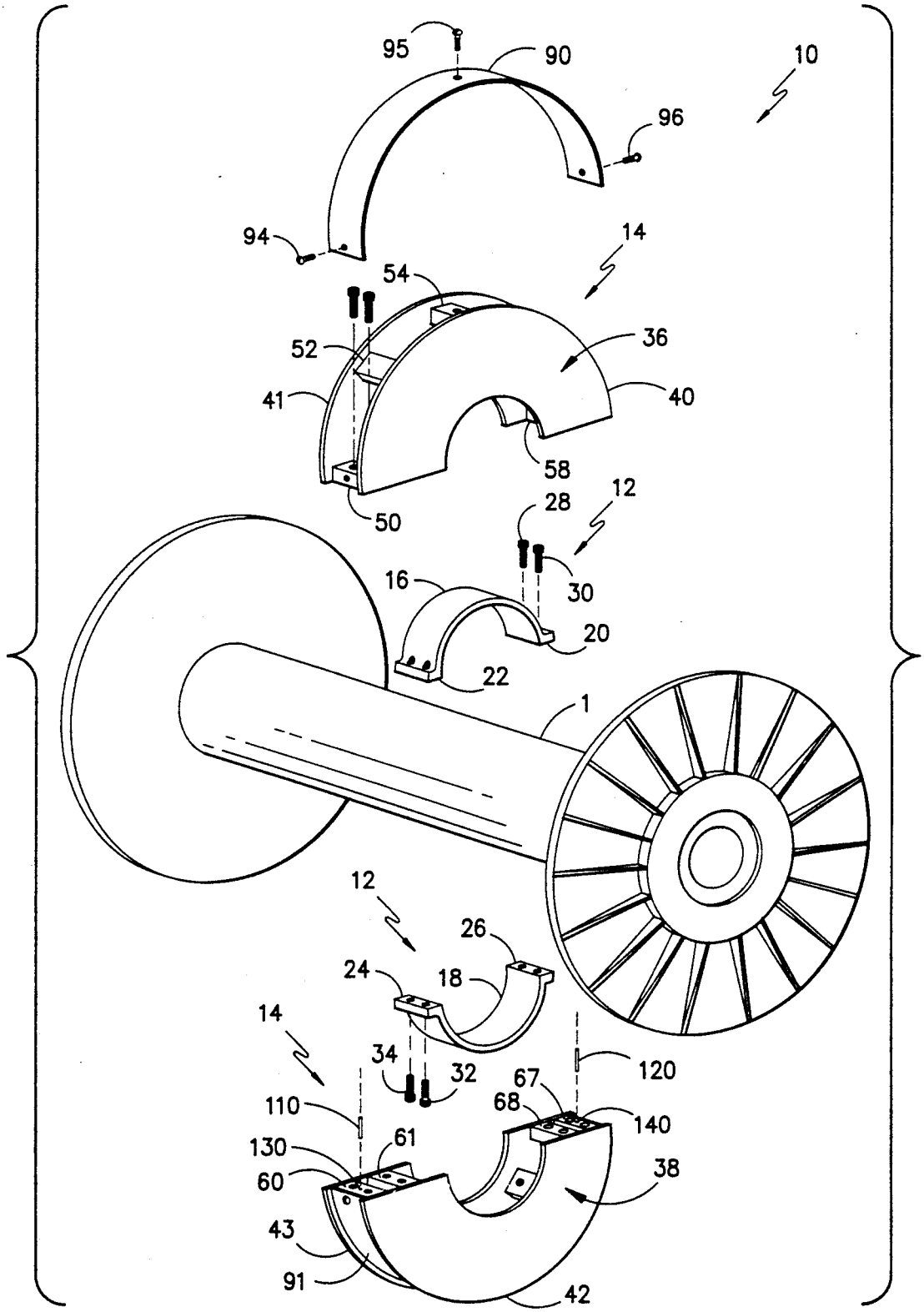
FIG. 1 is an exploded perspective view of the collar constructed according to the present invention.
Figure 2:
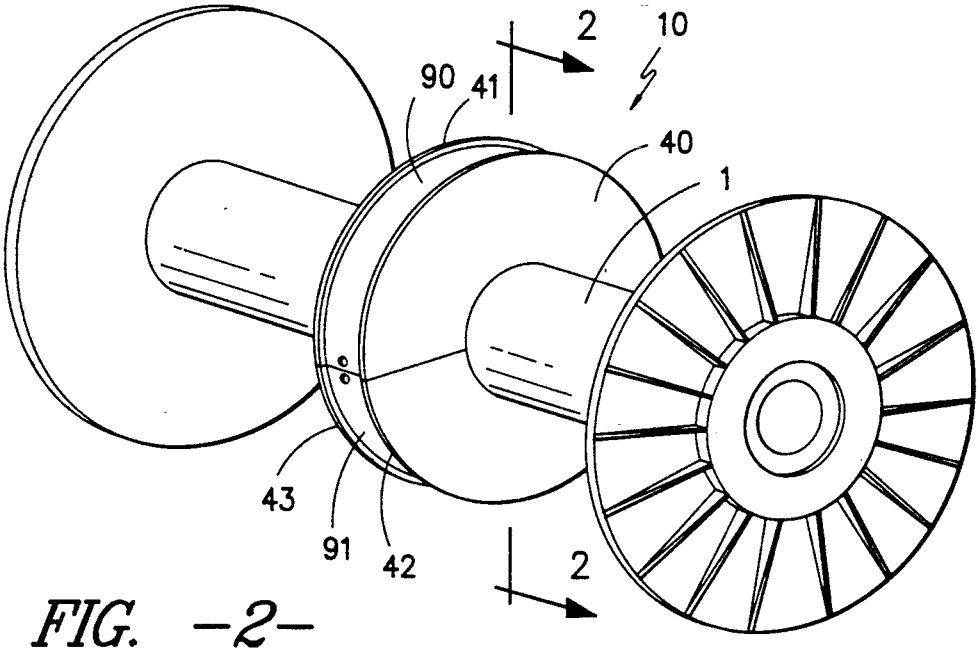
FIG. 2 is a perspective view of the collar constructed according the present invention which is secured to a beam.
Figure 3:
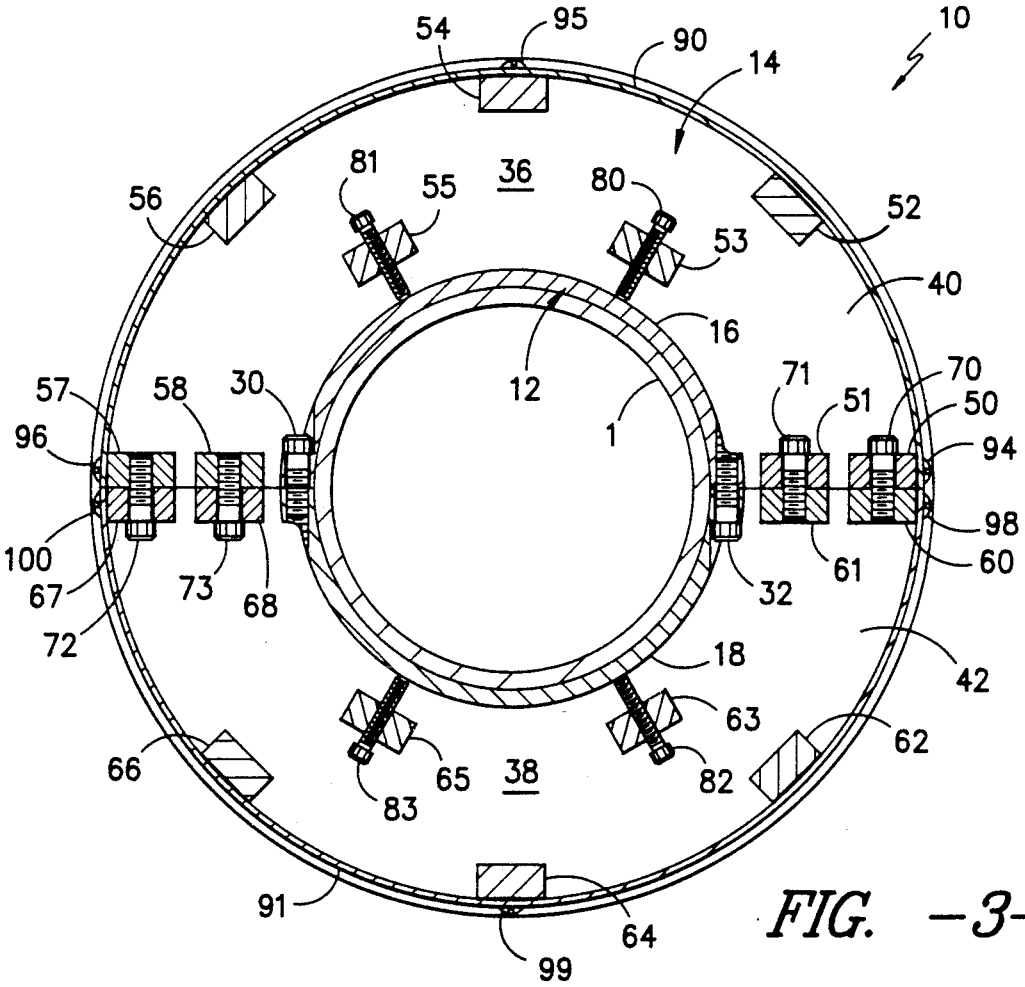
FIG. 3 is a sectional view taken along line 2-2 in FIG. 2.

Referring now by reference numerals to the drawings, and first to FIGS. 1-3, a collar to divide a section beam is generally indicated by numeral 10. Referring now to FIGS. 1 and 3, the collar 10 has two main components which are a friction hub 12 and a yarn divider 14 which are mounted on a beam 1 that has flanged ends.

The friction hub 12, in the form of a compression ring, includes substantially identical c-shaped members 16 and 18 that each have substantially flat end flanges 20, 22, 24 and 26 respectively. The two c-shaped members 16 and 18 are preferably constructed out of metal, but also may be made of plastic, ceramic and so forth. End flange 20 is attached to end flange 26 by means of bolts 28 and 30 and threaded openings in flange 26. End flange 22 is attached to end flange 24 by means of bolts 32 and 34 and threaded openings in flange 22. Any attachment means used in this application does not necessarily mean bolts, but any means of hardware, adhesives, and so forth will suffice or any combination thereof. There needs to be enough pressure to hold the friction hub 12 onto the beam 1 without damaging the beam 1 and yet still hold the friction hub 12 securely in place under the dynamic loadings of the warping operation.

The yarn divider 14 also has two substantially identical c-shaped sections 36 and 38 each having side walls 40, 41, 42, and 43 respectively, which all have an inner and outer radius. Side walls 40, 41, 42 and 43 are all machined smooth and flat so that they present a substantially smooth surface to the yarn with minimal surface interruption at the point of interconnection, which thereby eliminates any snagging of the yarn.

C-section 36 has rectangular support members 50, 51, 52, 53, 54, 55, 56, 57, and 58 while substantially identical c-section 38 has corresponding support members 60, 61, 62, 63, 64, 65, 66, 67, and 68 as shown in FIG. 3. There are holes 130 in support members 50 and 60 through which pin 110 (i.e., roll pin, taper pin, and so forth) is pressed as well as holes 140 in support members 57 and 67 through which pin 120 is pressed to line up side walls 40 and 42 as well as 41 and 43 when yarn divider 14 is assembled or disassembled, as shown in FIGS. 1 and 3. Support member 50 attaches to support member 60 by means of bolt 70 through a threaded opening, support member 51 attaches to support member 61 by means of bolt 71 through a threaded opening, support member 57 attaches to support member 67 by means of bolt 72 through a threaded opening, and support member 58 attaches to support member 68 by means of bolt 73 through a threaded opening. This results in the attachment of c-section 36 to c-section 38. C-section 36 has three support members 52, 54 and 56 equidistantly spaced along the outer radius with member 54 at the apex of the curve. This equidistant spacing is preferred, but not necessary. C-section 38 is identical with corresponding support members 62, 64 and 66. The primary function of the support members 52, 54, 56, 62, 64 and 66 is to serve as webs or spacers between plates 40, 41, 42 and 43 respectively.

Support members 53 and 55 are located relatively close to the inner radius of c-section 36. Bolt 80 goes through a threaded hole in support member 53 as well as bolt 81 going through a threaded hole in support member 55 to secure c-shaped section 36 to the first c-shape member 16 of friction hub 12. Bolt 82 goes through a threaded hole in support member 63 as well as bolt 83 going through a threaded hole in support member 65 to secure c-shaped section 38 to the second c-shape member 18 of friction hub 12. This results in the yarn divider 14 being fixedly attached to the friction hub 12. The friction hub 12 is in the form of a compression ring whose primary purpose is to prevent rotation and axial motion of yarn divider 14.

Collar 10 may be cast in two c-shaped components or in part utilizing welding, adhesives or other means of structural connection to interconnect components for the purpose of creating an economically viable product. The yarn divider 10 is provided with a relative axial location with reference to the beam 1 by having the side walls 40, 41, 42, and 43 fit over and enclose the friction hub 12. There is a slight amount of clearance between the side walls 40, 41, 42, and 43 and friction hub 12. A slight amount of clearance between side walls 40, 41, 42 and 43 and the beam 1 allows the divider 10 to rotate freely when not attached to the friction hub 12 by bolts 80, 81, 82 and 83.

There is a curved cover plate 90 that conforms to the outer radius of c-shaped member 36 and attaches by means of bolt 94 to support member 50, bolt 95 to support member 54 and bolt 96 to support member 57. There is a corresponding curved cover plate 91 for c-shaped member 38 and attaches by means of bolt 98 to support member 60, bolt 99 to support member 64 and bolt 100 to support member 67. This cover plate 90 provides primarily a safety function and can be made of virtually any material and attached by hardware, adhesives, and so forth. An assembled collar 10 is attached to a beam 1 as shown in FIG. 2.

For economic reasons, any piece or component in the present invention may be integrally formed with any other piece or component such as friction hub c-shaped member 16 formed with yarn divider c-shaped section 36 and friction hub c-shaped member 18 formed with yarn divider c-shaped section 38, and so forth.

Figure 4:
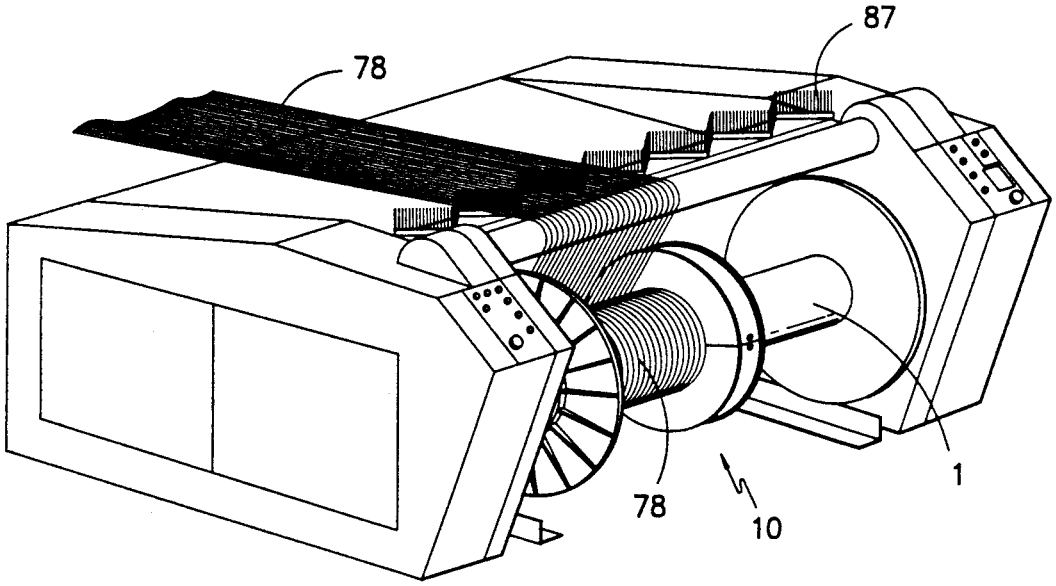
FIG. 4 is a perspective view of the collar constructed according to the present invention which is attached to a beam that is secured in a warper and has yarns drawn through a reed comb.

As shown in FIG. 4, the beam 1 is secured in a standard warper with the collar 10 being utilized to divide the beam 1 into independent sections thereby allowing the yarn 78 to run onto each independent section. The yarn 78 can be brought through a reed comb 87 that would be preferably movable. More than one collar 10 can be mounted on a single beam 1.

Therefore, it is not intended that the scope of the invention be limited to the specific embodiment illustrated and described. Rather, it is intended that the scope of the invention be defined by the appended claims and their equivalents.

What is claimed is:

1. A collar for partitioning a beam comprising:

(a) a first c-shaped member;

(b) a second c-shaped member;

(c) a first means to removedly attach said second c-shaped member to said first c-shaped member to form a first ring;

(d) a third c-shaped member;

(e) a fourth c-shaped member;

(f) a second means to removedly attach said fourth c-shaped member to said third c-shaped member to form a second ring; and (g) a third means to removedly attach said second ring to said first ring.

2. The collar according to claim 11, wherein said first c-shaped member includes opposed end portions.

3. The collar according to claim 2, wherein said second c-shaped member includes opposed end portions.

4. The collar according to claim 3, wherein said end portions of said first and second c-shaped members are substantially flat.

5. The collar according to claim 4, wherein said first means removedly attaches said end portions of said first and second c-shaped members to each other.

6. The collar according to claim 5, wherein said first means includes at least one bolt.

7. The collar according to claim 1, wherein said third c-shaped member includes opposed end portions.

8. The collar according to claim 7, wherein said fourth c-shaped member includes opposed end portions.

9. The collar according to claim 8, wherein said end portions of said third and fourth c-shaped members are substantially flat.

10. The collar according to claim 9, wherein said second means removedly attaches said end portions of said third and fourth c-shaped members to each other.

11. The collar according to claim 10, wherein said second means includes at least one bolt.

12. The collar according to claim 9, wherein said second means includes at least one pin.

13. The collar according to claim 9, wherein said second means includes at least one pin and at least one bolt.

14. A collar for partitioning a beam comprising:

(a) a first c-shaped member having opposed end portions;

(b) a second c-shaped member having opposed end portions;

(c) a first means to removedly attach said second c-shaped member to said first c-shaped member to form a first ring;

(d) a third c-shaped member having opposed end portions;

(e) a fourth c-shaped member having opposed end portions;

(f) a second means to removedly attach said fourth c-shaped member to said third c-shaped member to form a second ring; and (g) a third means to removedly attach said second ring to said first ring.

15. The collar according to claim 14, wherein said second means includes at least one pin.

16. A collar for partitioning a beam comprising:

(a) a first c-shaped member having opposed end portions;

(b) a second c-shaped member having opposed end portions;

(c) a first means to removedly attach said second c-shaped member to said first c-shaped member to form a first ring;

(d) a third c-shaped member having opposed end portions, wherein said third c-shaped member has a first side wall and a second side wall and a first support member located between said first side wall and said second side wall of said third c-shaped member;

(e) a fourth c-shaped member having opposed end portions;

(f) a second means to removedly attach said fourth c-shaped member to said third c-shaped member to form a second ring; and (g) a third means to removedly attach said second ring to said first ring.

17. The collar according to claim 16, wherein said fourth c-shaped member has a first side wall and a second side wall and a second support member located between said first side wall and said second side wall of said fourth c-shaped member.

18. The collar according to claim 17, further comprising a c-shaped cover member and a means for attaching said cover member to said second support member.

19. The collar according to claim 17, wherein said first ring having an outer perimeter and a means for attaching said outer perimeter to said fourth c-shaped member.

20. The collar according to claim 17, further comprising a means for positioning said first ring over said second ring and said positioning means is removedly attached to said second support member of said fourth c-shaped member.

21. The collar according to claim 16, further comprising a cover member and a means for attaching said cover member to said first support member.

22. The collar according to claim 16, wherein said first ring having an outer perimeter and a means for attaching said outer perimeter of said first ring to said third c-shaped member.

23. The collar according to claim 16, further comprising a means for positioning said first ring over said second ring and said positioning means is removedly attached to said first support member of said third c-shaped member.

24. A collar for partitioning a beam comprising:

(a) a first c-shaped member having opposed end portions;

(b) a second c-shaped member having opposed end portions;

(c) a first means to removedly attach said second c-shaped member to said first c-shaped member to form a first ring;

(d) a third c-shaped member having opposed end portions, wherein said third c-shaped member has a first side wall and as second side wall and a plurality of first support members located between said first side wall and said second side wall of said third c-shaped member;

(e) a fourth c-shaped member having opposed end portions;

(f) a second means to removedly attach said fourth c-shaped member to said third c-shaped member to form a second ring; and (g) a third means to removedly attach said second ring to said first ring.

25. The collar according to claim 24, wherein said fourth c-shaped member has a first side wall and a second side wall and a plurality of second support members located between said first side wall and said second side wall of said fourth c-shaped member.

26. The collar according to claim 25, further comprising a means for positioning said first ring over said second ring and said positioning means is removedly attached to said plurality of second support members of said fourth c-shaped member.

27. The collar according to claim 24, further comprising a means for positioning said first ring over said second ring and said positioning means is removedly attached to said plurality of first support members of said third c-shaped member.

28. A collar for positioning a beam comprising:

(a) a first c-shaped member having opposed end portions;

(b) a second c-shaped member having opposed end portions;

(c) a first means to removedly attached said second c-shaped member to said first c-shaped member to form a first ring;

(d) a third c-shaped member having opposed end portions;

(e) a fourth c-shaped member having opposed end portions;

(f) a second means to removedly attach said fourth c-shaped member to said third c-shaped member to form a second ring; and (g) a third means to removedly attach said second ring to said first ring, wherein said third and fourth c-shaped members having side walls which enclose said first ring to prevent axial displacement of said second ring.

* * * * *